US010731670B2

(12) United States Patent
Meid et al.

(10) Patent No.: US 10,731,670 B2
(45) Date of Patent: Aug. 4, 2020

(54) HYDRAULIC ARRANGEMENT

(71) Applicant: Deere & Company, Moline, IL (US)

(72) Inventors: Michael Meid, Waghaeusel (DE); Sebastian Traut, Langenfeld (DE)

(73) Assignee: DEERE & COMPANY, Moline, IL (US)

( * ) Notice: Subject to any disclaimer, the term of this patent is extended or adjusted under 35 U.S.C. 154(b) by 36 days.

(21) Appl. No.: 16/132,716

(22) Filed: Sep. 17, 2018

(65) Prior Publication Data

US 2019/0101136 A1 Apr. 4, 2019

(30) Foreign Application Priority Data

Oct. 2, 2017 (DE) ..... 10 2017 217 552

(51) Int. Cl.

| | |
|---|---|
| ***F15B 1/027*** | (2006.01) |
| ***F04B 49/06*** | (2006.01) |
| ***F04B 49/22*** | (2006.01) |
| ***F04B 49/08*** | (2006.01) |
| ***F04B 49/00*** | (2006.01) |

(52) U.S. Cl.

CPC ..... *F15B 1/027* (2013.01); *F04B 49/002* (2013.01); *F04B 49/06* (2013.01); *F04B 49/065* (2013.01); *F04B 49/08* (2013.01); *F04B 49/22* (2013.01); *F04B 2205/05* (2013.01); *F04B 2205/09* (2013.01)

(58) Field of Classification Search

CPC ..... F15B 1/021; F15B 1/024; F15B 1/025; F15B 1/027; F04B 49/08

USPC ..... 60/413, 452

See application file for complete search history.

(56) References Cited

U.S. PATENT DOCUMENTS

| | | | | |
|---|---|---|---|---|
| 3,779,017 A * | 12/1973 | Fujisawa | F15B 1/027 | 60/413 |
| 4,523,430 A * | 6/1985 | Masuda | F15B 11/02 | 60/452 |
| 5,355,676 A * | 10/1994 | Inokuchi | F15B 1/02 | 60/413 |
| 6,973,781 B2 * | 12/2005 | Brown | F15B 1/024 | 60/413 |

(Continued)

FOREIGN PATENT DOCUMENTS

| | | |
|---|---|---|
| DE | 202007014676 U1 | 2/2009 |
| DE | 102010053258 A1 | 6/2011 |

(Continued)

OTHER PUBLICATIONS

German Search Report issued in counterpart application No. 102017217552.4 dated May 15, 2018. (10 pages).

(Continued)

*Primary Examiner* — Michael Leslie

(57) ABSTRACT

A hydraulic arrangement includes a pump for delivering a hydraulic medium in a direction of a hydraulic working load. The pump includes an adjusting input for adjusting a delivery flow thereof. The arrangement also includes an accumulator unit hydraulically coupled on an output side to the pump and a charging valve unit hydraulically coupled on the output side of the pump between the pump and the accumulator unit. The charging valve unit is configured to function as a disconnectable hydraulic connection between the pump and the accumulator unit.

20 Claims, 1 Drawing Sheet

(56) References Cited

U.S. PATENT DOCUMENTS

| | | | | |
|---|---|---|---|---|
| 8,220,256 | B2 * | 7/2012 | Mueller | B60K 6/12 60/414 |
| 2009/0241534 | A1 * | 10/2009 | Tikkanen | F15B 1/024 60/413 |
| 2012/0043154 | A1 * | 2/2012 | Bitter | F15B 1/024 180/442 |
| 2017/0234338 | A1 * | 8/2017 | Spielvogel | F15B 1/024 60/629 |

FOREIGN PATENT DOCUMENTS

| | | | |
|---|---|---|---|
| DE | 102010014071 | A1 | 10/2011 |
| DE | 102010014071 | B4 | 12/2012 |
| DE | 102013211986 | A1 | 1/2015 |
| DE | 102014107240 | A1 | 11/2015 |
| DE | 102015206403 | A1 | 10/2016 |
| EP | 2420626 | A1 | 2/2012 |
| WO | 2011038706 | A1 | 4/2011 |

OTHER PUBLICATIONS

European Search Report issued in counterpart application No. 18197332.2 dated Nov. 19, 2018. (7 pages).

* cited by examiner

HYDRAULIC ARRANGEMENT

RELATED APPLICATIONS

This application claims priority to German Patent Application Ser. No. 102017217552.4, filed Oct. 2, 2017, the disclosure of which is hereby incorporated by reference in its entirety.

FIELD OF THE DISCLOSURE

The present disclosure relates to a hydraulic arrangement having a pump for delivering a hydraulic medium in the direction of a hydraulic working load.

BACKGROUND

A pump of a hydraulic arrangement delivers the hydraulic medium with a discrete displacement volume. This can lead to volume flow pulsations and therefore pressure pulsations, which are effectively reduced or avoided by an accumulator unit connected to the pump. The accumulator unit, however, can influence the hydraulic behavior of the arrangement.

There is a need therefore for improving the hydraulic behavior of the hydraulic arrangement.

SUMMARY

In a first embodiment of the present disclosure, a hydraulic arrangement includes a pump for delivering a hydraulic medium (e.g., oil) in the direction of a hydraulic working load, which acts as a hydraulic consumer. The pump is adjustable by means of an adjusting input so that it can always provide an adapted delivery volume or delivery quantity. In this way, the pump can operate from full delivery to zero delivery with respect to the hydraulic medium. The hydraulic arrangement additionally contains an accumulator unit (e.g., a diaphragm accumulator), which is hydraulically connected to the pump on the output side. The accumulator unit reduces any pressure pulsations and thus the associated stresses on components as well as disruptive noise from the hydraulic arrangement.

The hydraulic arrangement additionally comprises a charging valve unit charging and discharging the accumulator unit. The charging valve unit is hydraulically connected to the pump on the output side between the pump and the accumulator unit and acts with its different switching states as a disconnectable hydraulic connection between the pump and the accumulator unit. In this regard, it is possible for the charging valve unit to be bypassed by means of a check valve that is transmissive in the direction of the pump, wherein the check valve can be integrated structurally into the charging valve unit. In the direction of the accumulator unit, the check valve is closed.

The charging valve unit creates a technically simple and cost-effective prerequisite for the hydraulic arrangement showing a response behavior in different operating ranges of the pump that is substantially independent of changes of the delivery flow. Possible acoustical or mechanical vibrations in the hydraulic arrangement or hydraulic system are reduced or completely avoided, because a continuous filling and emptying of the accumulator unit can be actively damped by the charging valve unit.

In another embodiment, the hydraulic arrangement is used in a mobile hydraulic system in, for example, agriculture working machines, construction machines, or road construction vehicles. The hydraulic working load is accordingly contained in one of the above-mentioned mobile machines or vehicles. The hydraulic working load can be designed as a steering or braking unit, a hydraulic motor, a three-point hitch cylinder, or can be used in an attached implement for one of the above-mentioned machines or vehicles.

For an efficient functionality, the charging valve unit has two, more particularly exactly two, different switching positions. The charging valve unit is closed at maximum delivery flow (full delivery) of the pump while it is opened at a lower delivery flow, i.e., below the maximum delivery flow. In this manner, there is a hydraulic connection between the pump and the accumulator unit for a delivery flow less than the maximum delivery flow. The accumulator unit then fulfills the desired function of reducing pressure pulsations or of damping pulsations.

If there is a specific delivery flow or pressure requirement on the hydraulic system, the pump is adjusted in particular to full delivery. The charging valve unit then disconnects the accumulator unit from the hydraulic system and thereby avoids filling of the accumulator unit. In the event of changes of the delivery volume, this advantageously leads to a response behavior of the hydraulic system without an accumulator unit, so that disadvantages which would otherwise be caused by an accumulator unit such as reduced rigidity or excitation of vibrations in the hydraulic system are avoided. In certain operating states, the accumulator unit can also reduce a loss of pressure due to abrupt volume flow or pressure requests, particularly if the charging valve unit is bypassed by means of a check valve transmissive in the direction of the pump.

The charging valve unit is designed in a technically simple manner in that it is closed in a pressure-free state of the hydraulic control input and is open in a pressure state of the control input where hydraulic pressure has been applied. The charging unit can then be opened by means of a so-called pilot pressure at the control input. The charging valve unit has a conventional spring side (e.g., restoring spring), while the above-mentioned control input is arranged on an opposing side of the charging valve unit relative to the spring side.

In a further embodiment, the charging valve unit is constructed as a discrete or proportional 2/2 way valve with two connections and two switching positions and thereby can be provided economically as a standard component. Differing from this, the directional control valve can also have a greater number of switching positions.

In order to be able to adjust the pump in a controlled manner relative to the delivery flow, the adjusting input thereof is hydraulically connected to a controller output of a hydraulic control unit.

In another embodiment, the control input of the charging valve unit is hydraulically connected to the same controller output to which the adjusting input of the pump is hydraulically connected. In this way, a defined actuation (closing and opening) of the charging valve unit can be achieved depending on the delivery flow, with a simultaneously simple hydraulic structure of the hydraulic arrangement or hydraulic system.

In particular, the control unit contains a hydraulic volume flow controller or a hydraulic pressure controller. By means of these controllers, the hydraulic system can request a hydraulic volume flow or pressure. This request is implemented in the pump by an adjustment of the volume flow, in particular by full delivery. The volume flow controller or the pressure controller is designed as a directional control valve, such as a 3/2 way valve.

In order to be able to adjust the pump in a defined and technically simple manner, the adjusting input thereof has a restoring element (e.g., a restoring piston) to which a hydraulic pressure can be applied. For a limitation of the delivery flow below full delivery, an adjustment pressure is applied to the restoring element. This adjustment pressure can be controlled by the control unit such that the pump provides the adapted delivery flow. If there is a request for a volume flow or pressure of the hydraulic system, the pump can be adjusted by reducing the adjustment pressure in the direction of full delivery or by increasing the adjustment pressure in the direction of zero delivery.

BRIEF DESCRIPTION OF THE DRAWINGS

The above-mentioned aspects of the present disclosure and the manner of obtaining them will become more apparent and the disclosure itself will be better understood by reference to the following description of the embodiments of the disclosure, taken in conjunction with the accompanying drawings, wherein:

The FIGURE is a hydraulic circuit diagram with a hydraulic arrangement.

Corresponding reference numerals are used to indicate corresponding parts throughout the several views.

DETAILED DESCRIPTION

Figure 1:
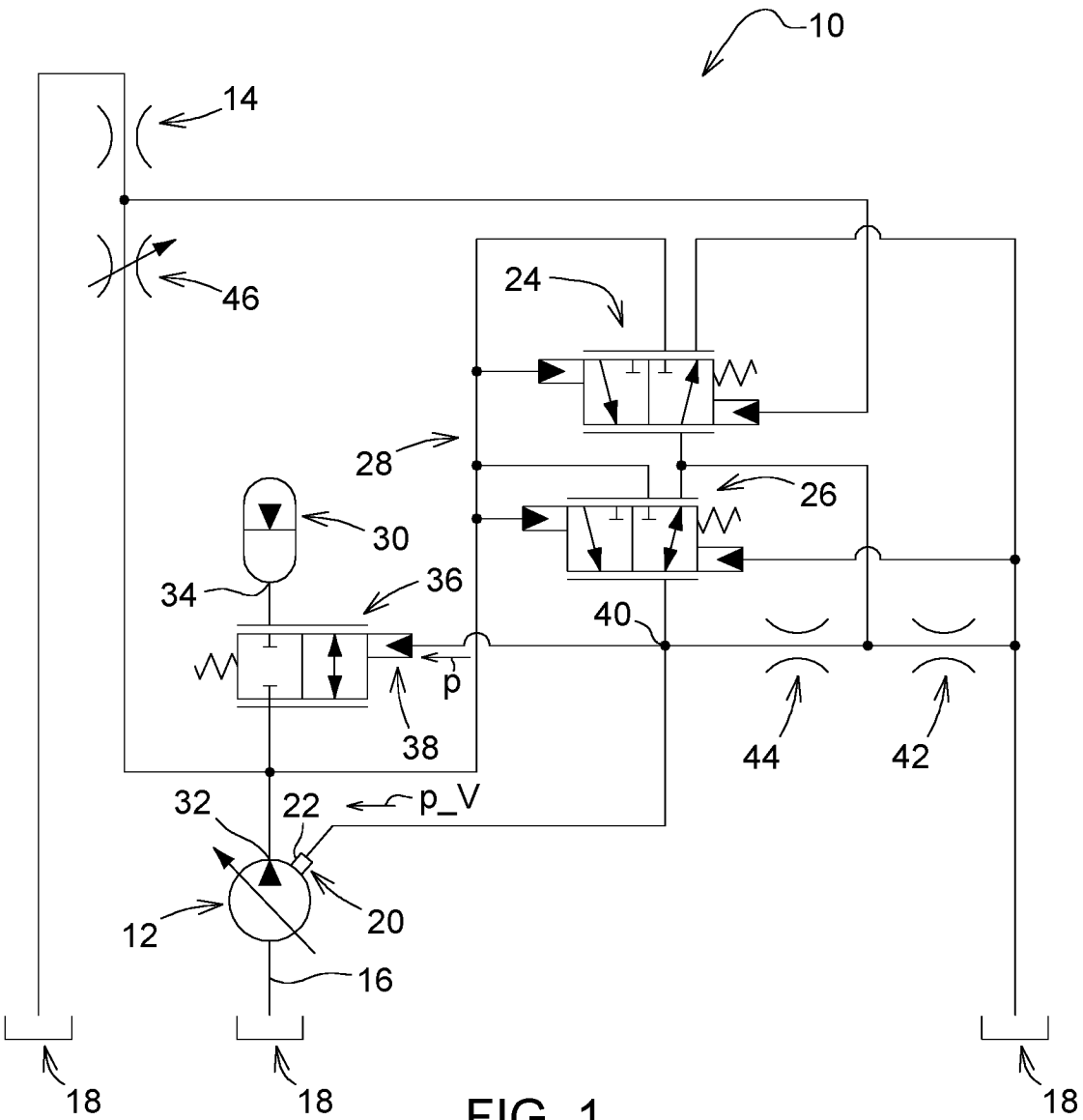

The embodiments of the present disclosure described below are not intended to be exhaustive or to limit the disclosure to the precise forms disclosed in the following detailed description. Rather, the embodiments are chosen and described so that others skilled in the art may appreciate and understand the principles and practices of the present disclosure.

FIG. 1 shows a hydraulic arrangement 10 or a hydraulic system having a pump 12 for delivering a hydraulic medium (e.g., oil) in the direction of a hydraulic working load 14. The pump 12 in this case is connected by a suction line 16 to a hydraulic container 18 or reservoir containing the hydraulic medium.

The pump 12 has an adjusting input in order to adjust a hydraulic delivery flow. For this purpose, the adjusting input 20 has a restoring element 22 in the form of a restoring piston not shown in detail. An adjustment pressure p_V is applied to this restoring element 22 for a delivery flow less than full delivery. The adjustment pressure p_V is controlled by a hydraulic volume flow controller 24 and a hydraulic pressure controller 26 within a control unit 28 in such a manner that the pump 12 provides a correspondingly dimensioned delivery flow. If there is a request for a volume flow or pressure of the hydraulic system, the pump 12 is adjusted by reducing the adjustment pressure in the direction of full delivery or by increasing the adjustment pressure in the direction of zero delivery.

To reduce or avoid pulsations of delivery flow and pressure in the hydraulic system, an accumulator unit 30 is hydraulically connected to the pump 12 on the output side. A charging valve unit 36 is hydraulically connected between the pump output 32 of the pump 12 and an accumulator connection 34 of the accumulator unit 30. The charging valve unit 36 is constructed as a 2/2 way valve having two connections and two switching positions. By means of the charging valve unit 36, a disconnectable hydraulic connection is established between the pump 12 and the accumulator unit 30. In one embodiment, the charging valve unit 36 is bypassed by a check valve transmissive in the direction of the pump 12, the check valve being structurally integrated into the charging valve unit 36.

In the depressurized state of a hydraulic control input 38, the charging valve unit 36 is closed, and is open in a pressure state in which a hydraulic pressure (pilot pressure) p is applied to the control input 38. The control input 38 and the adjusting input 22 are hydraulically connected to a controller output 40 of the control unit 28. This results in an advantageous response behavior of the hydraulic arrangement 10 or the hydraulic system with a simple structure and corresponding dimensioning of the charging valve unit 36. In the operating range of the pump 12 that is critical in terms of acoustics and vibration, the pump is set to a delivery flow less than full delivery. A specific adjusting pressure p_V is always applied to the restoring element 22 and thus limits the delivery flow. Consequently, a specific pressure p is applied to the control input 38, and the charging valve unit 36 is accordingly opened. The accumulator unit 30 thus fulfills the desired function of pulsation damping.

For a specific volume flow or pressure requirement of the hydraulic system, the pump 12 is adjusted to a full delivery (maximum delivery flow) by releasing the control pressure p_V at the control input 20. In this case, the control input 38 is in a depressurized state and the charging valve unit 36 is accordingly closed. The charging valve unit 36 consequently disconnects the accumulator unit 30 from the hydraulic system and thereby avoids filling of the accumulator unit 30. This leads to a response behavior of the hydraulic arrangement or the hydraulic system that is comparable to a hydraulic system without such an accumulator unit 30. A negative effect of the accumulator unit 30 on the hydraulic system can thus be excluded.

In the present embodiment, the hydraulic arrangement 10 contains single damping orifice plates 42 and 44, which are arranged one after another hydraulically between the controller output 40 and the hydraulic container 18.

The volume flow controller 24 and the pressure controller 26 are each constructed as a 3/2 way valve.

A so-called measuring orifice plate 46, at which the control pressure difference of the volume flow control 24 falls, is arranged between the pump output 32 and the working load 14. The volume flow can be varied by adjusting the measuring orifice plate 46. The volume flow is thus independent of the working load 14. The measuring orifice plate 46 constitutes a simplified control device in that respect. In additional embodiments, several control devices of this kind can be connected at the pump output 32 in parallel to corresponding working loads or consumers. In this case, the measuring orifice plate 46 or the control device formed thereby can be supplemented with a pressure gauge in order to keep the volume flow constant by adapting the control pressure difference present at the measuring shutter 46.

While exemplary embodiments incorporating the principles of the present disclosure have been disclosed hereinabove, the present disclosure is not limited to the disclosed embodiments. Instead, this application is intended to cover any variations, uses, or adaptations of the disclosure using its general principles. Further, this application is intended to cover such departures from the present disclosure as come within known or customary practice in the art to which this disclosure pertains and which fall within the limits of the appended claims.

The invention claimed is:

1. A hydraulic arrangement, comprising:

a pump for delivering a hydraulic medium in a direction of a hydraulic working load, the pump comprising an adjusting input for adjusting a delivery flow thereof;

an accumulator unit hydraulically coupled on an output side of the pump; and a charging valve unit hydraulically coupled on the output side of the pump between the pump and the accumulator unit;

wherein, the charging valve unit is configured to function as a disconnectable hydraulic connection between the pump and the accumulator unit;

wherein the charging valve unit comprises at least two different switching states;

wherein the charging valve unit is closed when the delivery flow of the pump is at a maximum delivery current; and the charging valve unit is opened when the delivery flow is less than the maximum delivery current.

2. The arrangement of claim 1, wherein the charging valve unit is bypassed by means of a check valve transmissive in the direction of the pump and closed in the direction of the accumulator unit.

3. The arrangement of claim 1, wherein the charging valve unit is opened in a pressure state of a hydraulic control input in which a hydraulic pressure is applied.

4. The arrangement of claim 3, wherein the charging valve unit is closed if the control input is depressurized.

5. The arrangement of claim 1, wherein the charging valve unit comprises a 2/2-way valve.

6. The arrangement of claim 1, further comprising a hydraulic control unit hydraulically connected at a controller output to the adjusting input of the pump.

7. The arrangement of claim 1, wherein the adjusting input of the pump comprises a restoring element to which pressure can be applied by means of a hydraulic pressure.

8. A hydraulic arrangement, comprising:

a pump for delivering a hydraulic medium in a direction of a hydraulic working load, the pump comprising an adjusting input for adjusting a delivery flow thereof;

an accumulator unit hydraulically coupled on an output side of the pump; and a charging valve unit hydraulically coupled on the output side of the pump between the pump and the accumulator unit;

a hydraulic control unit hydraulically connected at a controller output to the adjusting input of the pump;

wherein, the charging valve unit is configured to function as a disconnectable hydraulic connection between the pump and the accumulator unit;

wherein a hydraulic control input of the charging valve unit is hydraulically connected to the controller output of the control unit.

9. The arrangement of claim 8, wherein the charging valve unit comprises at least two different switching states.

10. The arrangement of claim 9, wherein:

the charging valve unit is closed when the delivery flow of the pump is at a maximum delivery current; and the charging valve unit is opened when the delivery flow is less than the maximum delivery current.

11. The arrangement of claim 8, wherein the control unit comprises a hydraulic volume flow controller or a hydraulic pressure controller.

12. A hydraulic arrangement, comprising:

a pump for delivering a hydraulic medium in a direction of a hydraulic working load, the pump comprising an adjusting input for adjusting a delivery flow thereof;

an accumulator unit hydraulically coupled on an output side of the pump;

a charging valve unit hydraulically coupled on the output side of the pump between the pump and the accumulator unit; and a hydraulic control unit hydraulically connected at a controller output to the adjusting input of the pump;

wherein, the charging valve unit is configured to function as a disconnectable hydraulic connection between the pump and the accumulator unit;

wherein the charging valve unit comprises at least two different switching states;

wherein the charging valve unit is closed when the delivery flow of the pump is at a maximum delivery current; and the charging valve unit is opened when the delivery flow is less than the maximum delivery current.

13. The arrangement of claim 12, wherein the charging valve unit is bypassed by means of a check valve transmissive in the direction of the pump and closed in the direction of the accumulator unit.

14. The arrangement of claim 12, wherein:

the charging valve unit is opened in a pressure state of a hydraulic control input in which a hydraulic pressure is applied; and the charging valve unit is closed if the control input is depressurized.

15. The arrangement of claim 12, wherein the charging valve unit comprises a 2/2-way valve.

16. The arrangement of claim 12, wherein the adjusting input of the pump comprises a restoring element to which pressure can be applied by means of a hydraulic pressure.

17. A hydraulic arrangement, comprising:

a pump for delivering a hydraulic medium in a direction of a hydraulic working load, the pump comprising an adjusting input for adjusting a delivery flow thereof;

an accumulator unit hydraulically coupled on an output side of the pump;

a charging valve unit hydraulically coupled on the output side of the pump between the pump and the accumulator unit; and a hydraulic control unit hydraulically connected at a controller output to the adjusting input of the pump;

wherein, the charging valve unit is configured to function as a disconnectable hydraulic connection between the pump and the accumulator unit;

wherein a hydraulic control input of the charging valve unit is hydraulically connected to the controller output of the control unit.

18. The arrangement of claim 17, wherein the charging valve unit comprises at least two different switching states.

19. The arrangement of claim 18, wherein:

the charging valve unit is closed when the delivery flow of the pump is at a maximum delivery current; and the charging valve unit is opened when the delivery flow is less than the maximum delivery current.

20. The arrangement of claim 17, wherein the control unit comprises a hydraulic volume flow controller or a hydraulic pressure controller.

* * * * *